US006548994B2

(12) United States Patent
Jang

(10) Patent No.: US 6,548,994 B2
(45) Date of Patent: Apr. 15, 2003

(54) REFERENCE VOLTAGE GENERATOR TOLERANT TO TEMPERATURE VARIATIONS

(75) Inventor: Seong-jin Jang, Sungnam (KR)

(73) Assignee: Samsung Electronics Co., Ltd. (KR)

( * ) Notice: Subject to any disclaimer, the term of this patent is extended or adjusted under 35 U.S.C. 154(b) by 0 days.

(21) Appl. No.: 09/993,817

(22) Filed: Nov. 14, 2001

(65) Prior Publication Data

US 2002/0175663 A1 Nov. 28, 2002

(30) Foreign Application Priority Data

May 10, 2001 (KR) ..... 01-25574

(51) Int. Cl.[7] ..... G05F 3/16
(52) U.S. Cl. ..... 323/313; 323/907; 327/537
(58) Field of Search ..... 323/313, 314, 323/315, 316, 907; 327/537, 538, 539, 535, 541

(56) References Cited

U.S. PATENT DOCUMENTS 5,309,083 A * 5/1994 Pierret et al. ..... 323/313
5,900,772 A * 5/1999 Someville ..... 327/539

* cited by examiner

*Primary Examiner*—Rajnikant B. Patel
(74) *Attorney, Agent, or Firm*—F. Chau & Associates, LLP

(57) ABSTRACT

A reference voltage generator capable of stably generating a reference voltage irrespective of temperature variations is provided. The reference voltage generator includes a voltage bias unit having a plurality of resistors and a first group of transistors serially connected between a power supply voltage node and a ground voltage node, a reference voltage node connected to one of the plurality of resistors or transistors to produce a preliminary reference voltage; a voltage controller connected between the preliminary reference voltage node and the ground voltage node; a temperature compensator having a second group of transistors serially connected between the preliminary reference voltage node and a reference voltage node to produce a reference voltage; and a voltage compensator having a third group of transistors serially connected between the reference voltage node and the ground voltage node for controlling the reference voltage. The temperature compensator compensates for temperature variation and the voltage compensator maintains the reference voltage at a predetermined value regardless of the temperature variation. Thus, the reference voltage generator can generate a stable reference voltage.

10 Claims, 4 Drawing Sheets

REFERENCE VOLTAGE GENERATOR TOLERANT TO TEMPERATURE VARIATIONS

BACKGROUND OF THE INVENTION

1. Field of the Invention

The present invention relates to a semiconductor integrated circuit, and more particularly, to a reference voltage generator capable of stably generating a reference voltage regardless of temperature variations.

2. Discussion of Related Art

In general, a reference voltage can be used as a threshold voltage against which data is compared to determine the logic level of the data. If the voltage of the data is lower than the reference voltage, the logic level of data is logic "low". If the voltage of the data is higher than the reference voltage, the logic level of data is logic "high". Accordingly, if the reference voltage is varied, the logic level of data is also varied.

FIG. 1 is a circuit diagram of a conventional reference voltage generator. Referring to FIG. 1, a reference voltage generator 100 includes a voltage bias unit 101, a voltage controller 103, and a capacitor 105. The voltage bias unit 101 includes a voltage divider which outputs a reference voltage VREF, the voltage value is determined by resistors R1~R5 and a first group of transistors M1~M20 serially connected between a power supply voltage VDD and a ground voltage VSS. The reference voltage VREF is outputted at the node between a first resistor R1 and second~fifth resistors R2~R5 and a first group of transistors M1~M20.

The voltage controller 103 controls the reference voltage VREF using a second group of transistors M31 and M32 connected between the reference voltage VREF and the ground voltage VSS. The second group of transistors M31 and M32 are turned on/off by a voltage applied at their gates at node A. The voltage applied at the node A can be varied by programming fuses F1, F2, and F3, in which each fuse acts as a short-circuit to bypass each of the third, fourth, and fifth resistors R3, R4, and R5, respectively, unless the fuse is cut or blown. When the second group of transistors M31 and M32 are turned on, the reference voltage VREF is pulled toward VSS and therefore the voltage is decreased. When the second group of transistors M31 and M32 are turned off, the reference voltage VREF is maintained at the voltage level based on the voltage divider configuration of the voltage bias unit 101. The capacitor 105 is charged by the reference voltage VREF for maintaining the reference voltage VREF to each circuit connected to the reference voltage VREF. The reference voltage is expressed by Formula (1):

$$VREF = Vtp\left(1 + \frac{Rch}{R1}\right) \tag{1}$$

where Vtp indicates the threshold voltage of the second group of transistors M31 and M32, Rch indicates the channel resistance of the first group of transistors M1~M20, and R1 indicates the resistance of the first resistor R1 of the voltage bias unit 101.

In the reference voltage generator 100, if the power supply voltage VDD is decreased, the reference voltage VREF is also decreased. If the reference voltage VREF is decreased, the variation range of the reference voltage VREF due to temperature variations is widened. It is known that Rch varies to a much larger extent as compared to Vtp and R1 when temperature is varied. In other words, the variation of the reference voltage VREF due to temperature variation is based largely on the variation of Rch.

SUMMARY OF THE INVENTION

It is an object of the present invention to provide a reference voltage generator capable of stably generating a reference voltage regardless of temperature variations.

According to an aspect of the present invention, a reference voltage generator comprises a voltage bias unit having a plurality of resistors and a first group of transistors serially connected between a power supply voltage node and a ground voltage node, and a preliminary reference voltage node connected to one of the plurality of resistors or transistors to produce a preliminary reference voltage; a voltage controller connected between the preliminary reference voltage node and the ground voltage node to adjust the preliminary reference voltage; a temperature compensator having a second group of transistors serially connected between the preliminary reference voltage node and a reference voltage node to compensate for temperature variation and produce a reference voltage; and a voltage compensator having a third group of transistors serially connected between the reference voltage node and the ground voltage node for controlling the reference voltage.

In the reference voltage generator, each of the gates of the second group of transistors is connected to the ground voltage node and a source or drain selectively short-circuited. Each of the gates of the third group of transistors is connected to the preliminary reference voltage node and a source or drain selectively short-circuited.

According to another aspect of the present invention, a reference voltage generator comprises a voltage bias unit having a first group of resistors and a first group of transistors serially connected between a power supply voltage node and a ground voltage node, and a preliminary reference voltage node connected to one of the first group of resistors or the first group of transistors to produce a preliminary reference voltage; a voltage controller connected between the preliminary reference voltage node and the ground voltage node to control the preliminary reference voltage; a temperature compensator having a second group of resistors serially connected between the preliminary reference voltage node and a reference voltage node; and a voltage compensator having a second group of transistors serially connected between the reference voltage node and the ground voltage node. The voltage compensator and the temperature compensator are connected to compensate for temperature variation and produce a reference voltage.

Advantageously, the reference voltage generator according to the present invention can stably generate a reference voltage by minimizing the variation of the reference voltage with respect to temperature variations.

BRIEF DESCRIPTION OF THE DRAWINGS

The above objects and advantages of the present invention will become more apparent by describing in detail preferred embodiments thereof with reference to the attached drawings in which.

DESCRIPTION OF PREFERRED EMBODIMENTS

Figure 1:
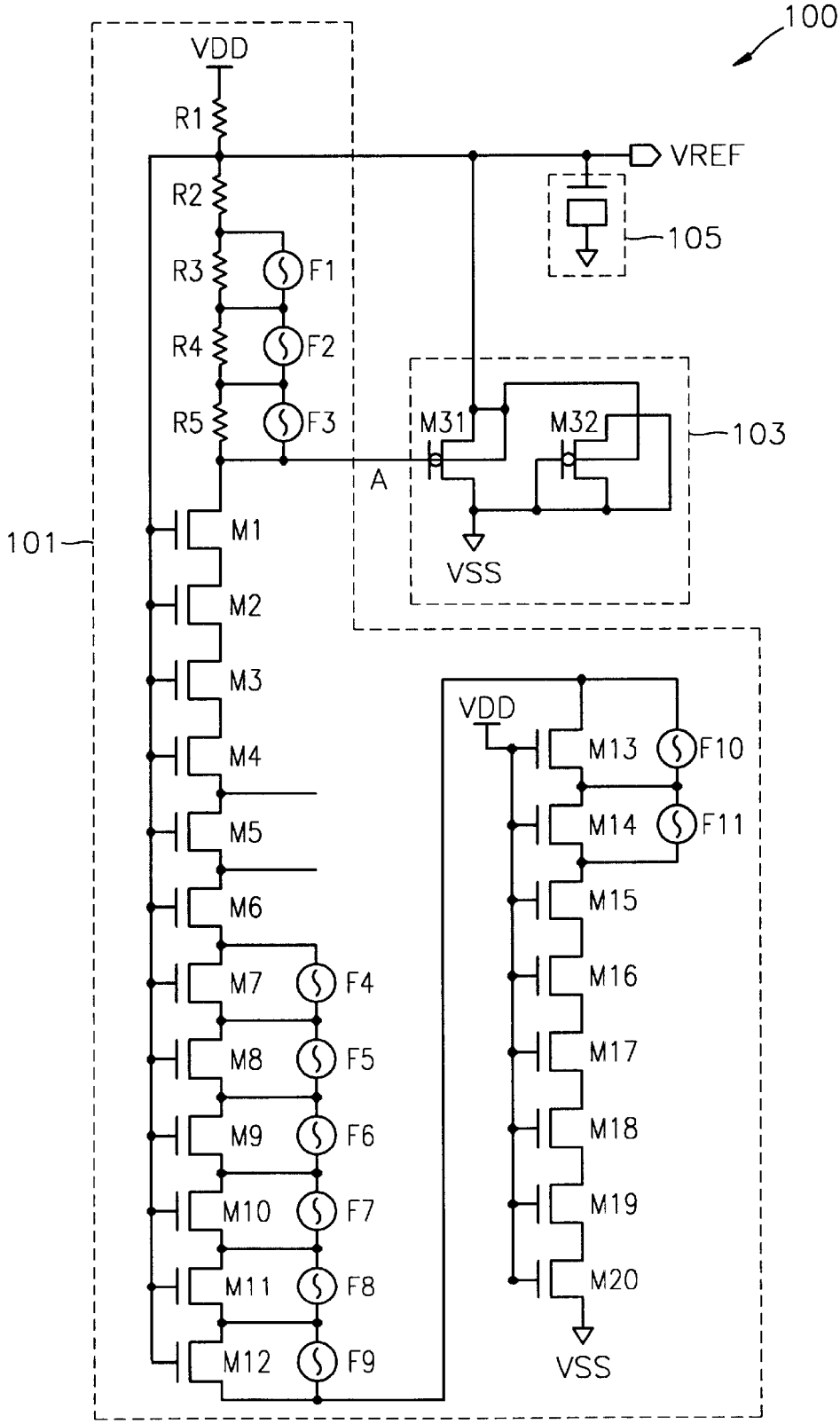
FIG. 1 (PRIOR ART)
FIG. 1 is a circuit diagram of a conventional reference voltage generator.

The present invention will now be described more fully with reference to the accompanying drawings, in which preferred embodiments of the invention are shown. The same reference numerals in different drawings represent the same element, and thus their description will be omitted.

Figure 2:
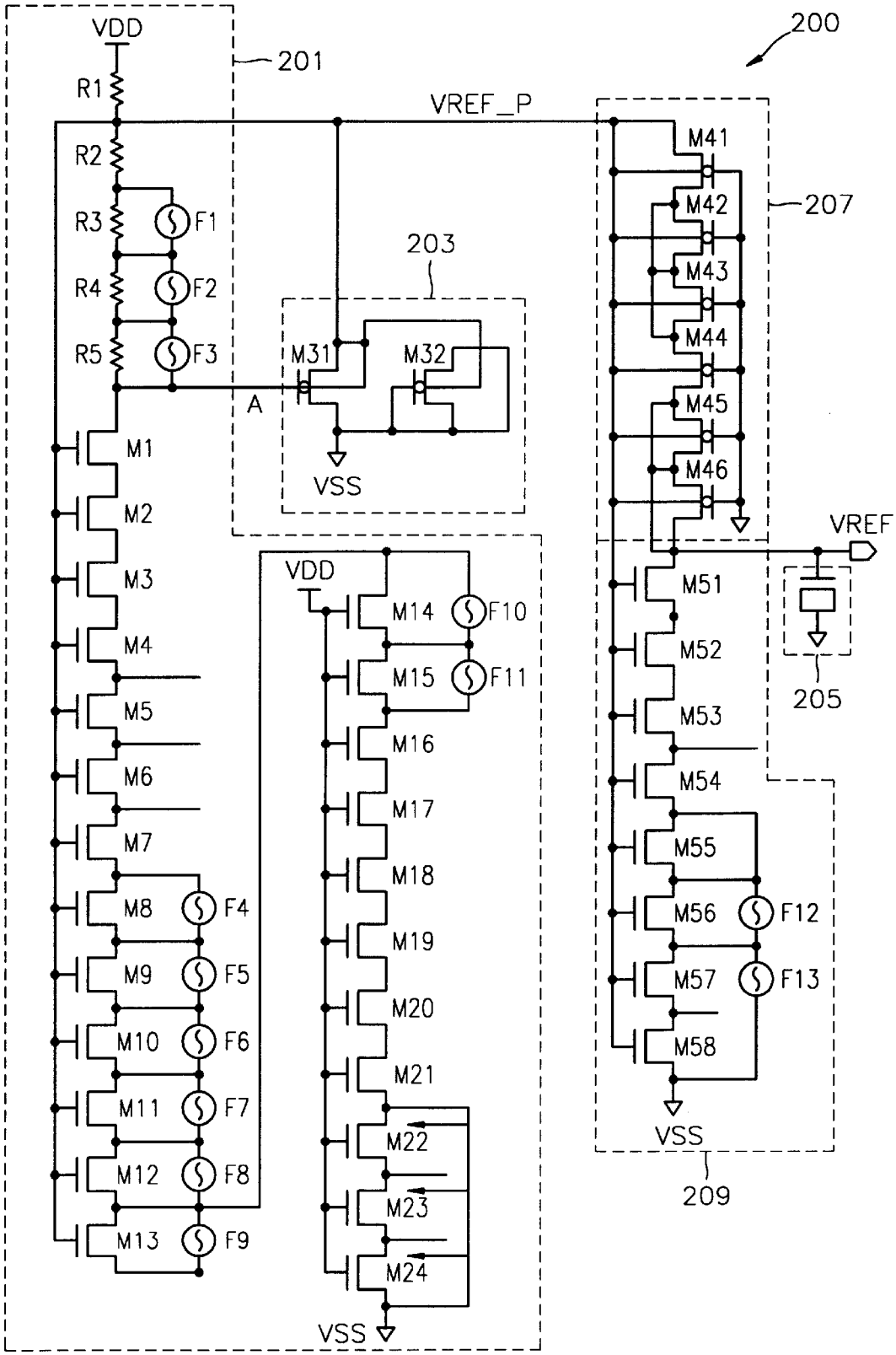
FIG. 2 is a circuit diagram of a reference voltage generator according to a preferred embodiment of the present invention.

FIG. 2 is a circuit diagram of a reference voltage generator 200 according to a preferred embodiment of the present invention. Referring to FIG. 2, a reference voltage generator 200 includes a voltage bias unit 201, a voltage controller 203, a capacitor 205, a temperature compensator 207, and a voltage compensator 209.

The voltage bias unit 201 comprises a plurality of resistors R1~R5 and a first group of transistors M1~M24 serially connected between a power supply voltage VDD node and a ground voltage VSS node, and sets a preliminary reference voltage VREF_P to be a reference voltage VREF. In particular, the voltage bias unit 201 sets the preliminary reference voltage VREF_P by dividing the voltage between a first resistor R1, and second~fifth resistors R2~R5 and the first group of transistors M1~M24. The voltage controller 203 comprises a second group of transistors M31 and M32 connected to the preliminary reference voltage VREF_P node and the ground voltage VSS node, and controls the preliminary reference voltage VREF_P. The transistor M31 decreases or maintains the preliminary reference voltage VREF_P by a voltage applied its gate at node A. The voltage at the node A is varied by programming fuses F1, F2, and F3, in which each fuse acts as a short-circuit to bypass each of the third, fourth, and fifth resistors R3, R4, and R5, respectively.

The temperature compensator 207 includes a third group of transistors M41~M46 serially connected between the preliminary reference voltage VREF_P node and the reference voltage VREF node. The third group of transistors M41~M46 are preferably PMOS transistors whose gates are connected to the preliminary reference voltage VREF_P node. Since the source or drain of each PMOS transistor can be selectively short-circuited, the resistance of the temperature compensator 207 can be decreased, whereby the variation of the reference voltage VREF can be controlled.

The voltage compensator 209 includes a fourth group of transistors M51~M58 serially connected between the reference voltage VREF node and the ground voltage VSS node. The fourth group of transistors M51~M58 are preferably NMOS transistors whose gates are connected to the preliminary reference voltage VREF_P node. Since the source or drain of each NMOS transistor can be selectively short-circuited, like the PMOS transistors described above, the resistance of the voltage compensator 209 can be decreased and the variation of the reference voltage VREF can be controlled.

The capacitor 205 is charged to the reference voltage VREF to supply the reference voltage VREF to each circuit block using the reference voltage VREF.

Hereinafter, the operation of the reference voltage generator 200 will be described. When the operational temperature of the reference voltage generator 200 drop to a normal temperature below, because a threshold voltage of the first group of transistors M1~M24 in the voltage bias unit 201 increases and the internal resistance of the first group of transistors M1~M24 increases, the preliminary reference voltage VREF_P at the temperature becomes higher than that at the normal temperature. As the preliminary reference voltage VREF_P increases, the reference voltage VREF increases. However, the increase of the preliminary reference voltage VREF_P increases the amount of current through the voltage compensator 209, thereby decreases the reference voltage VREF. As a result, the reference voltage VREF does not increase, but maintains at a predetermined value.

On the other hand, when the operational temperature of the reference voltage generator 200 rises, the threshold voltage of the PMOS transistors M41~M46 of the temperature compensator 207 decreases. As the internal resistance of each of the PMOS transistors M41~M46 decreases, the reference voltage increases. However, because of the decreased internal resistance of each of the PMOS transistors M41~M46, the amount of current flowing between the PMOS transistors M41~M46 and the NMOS transistors M51~M58 increases. As a result, the reference voltage VREF decreases by the interaction between the PMOS transistors M41~M46 of the temperature compensator 207 and the NMOS transistors M51~M58 of the voltage compensator 209.

The reference voltage VREF generated by the reference voltage generator 200 is expressed by Formula (2):

$$VREF = \text{VREF_p} * \frac{Rchn}{(Rchn + Rchp)} \tag{2}$$

where Rchn indicates the channel resistance of the voltage compensator 209 and Rchp indicates the channel resistance of the temperature compensator 207. As the power supply voltage VDD decreases, the reference voltage VREF generated by the reference voltage generator 200 decreases. Since the channel resistance Rchn and Rchp vary according to temperature variations, the variation of the reference voltage VREF is not as large as the variation of the reference voltage VREF expressed by Formula (1).

As described above, the reference voltage generator 200 maintains the reference voltage VREF at a predetermined value regardless of temperature variations by using the interactions between the temperature compensator 207 and the voltage compensator 209.

Figure 3A:
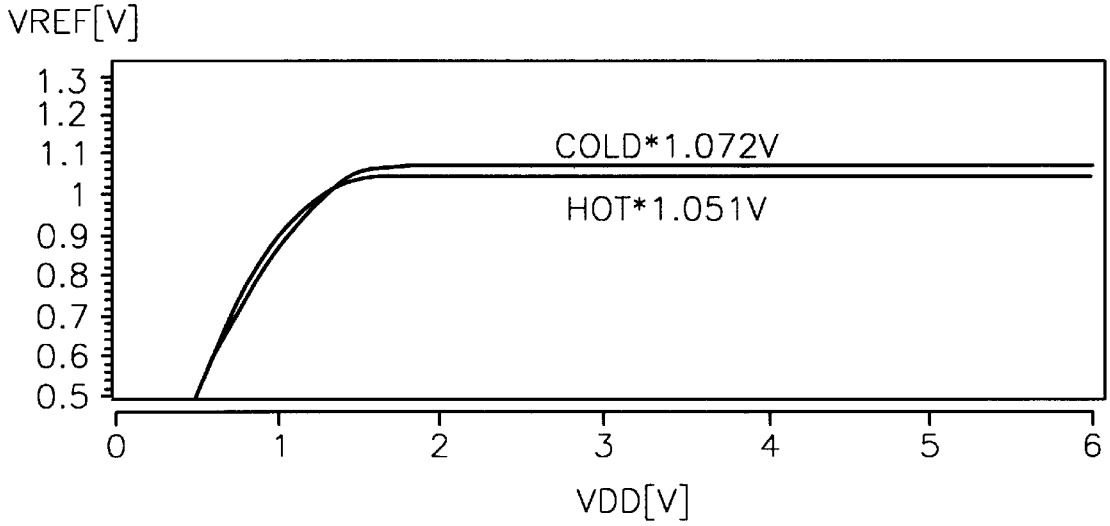
FIG. 3A is a graph showing the simulation results of the reference voltage generator shown in FIG. 2.
Figure 3B:
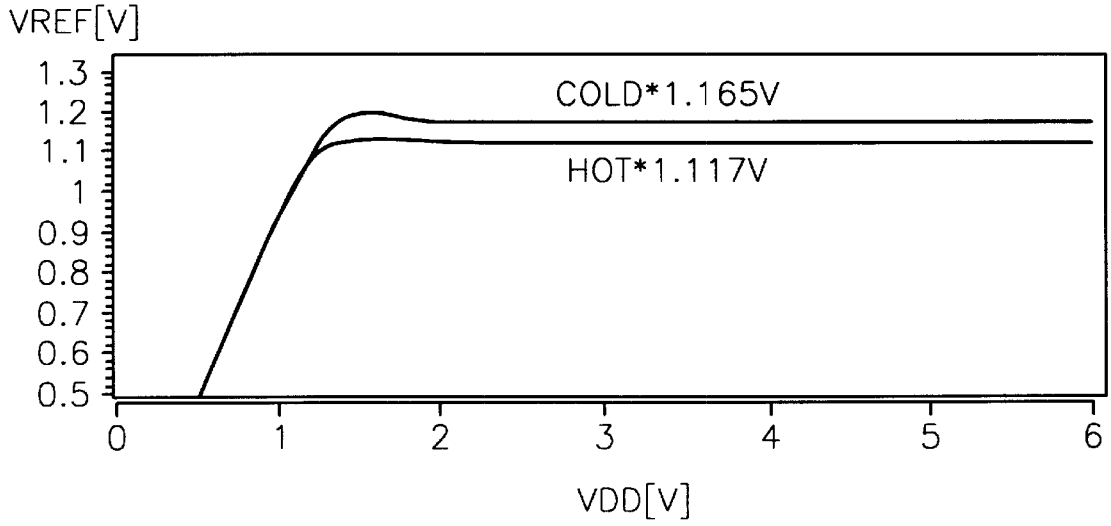
FIG. 3B is a graph showing the simulation results of the reference voltage generator shown in FIG. 1.

FIGS. 3A and 3B are graphs showing the simulation results of the reference voltage generators 200 and 100 shown in FIGS. 2 and 1, respectively. Specifically, FIGS. 3A and 3B show the reference voltage VREF varies according to the power supply voltage VDD and temperature variations.

FIG. 3A shows the output of the reference voltage generator 200 according to the preferred embodiment of the present invention shown in FIG. 2. Referring to FIG. 3A, when the power supply voltage is 3V, the reference voltage VREF is 1.051 V at a high temperature (HOT) and is 1.072 V at a low temperature (COLD). In other words, when temperature varies between HOT and COLD, the variation range of the reference voltage VREF is about 20 mV. FIG. 3B shows the output of the reference voltage generator 100 shown in FIG. 1. Referring to FIG. 3B, when the power supply voltage is 3 V, the reference voltage VREF is 1.117 V at the high temperature (HOT) and is 1.169 V at the low temperature (COLD). In other words, when temperature varies between HOT and COLD, the variation range of the reference voltage VREF is about 50 mV. Thus, compared with the conventional reference voltage generator 100 shown in FIG. 1, the reference voltage generator 200 according to the embodiment of the present invention shown in FIG. 2 shows a smaller amount of variation of the reference voltage VREF.

Figure 4:
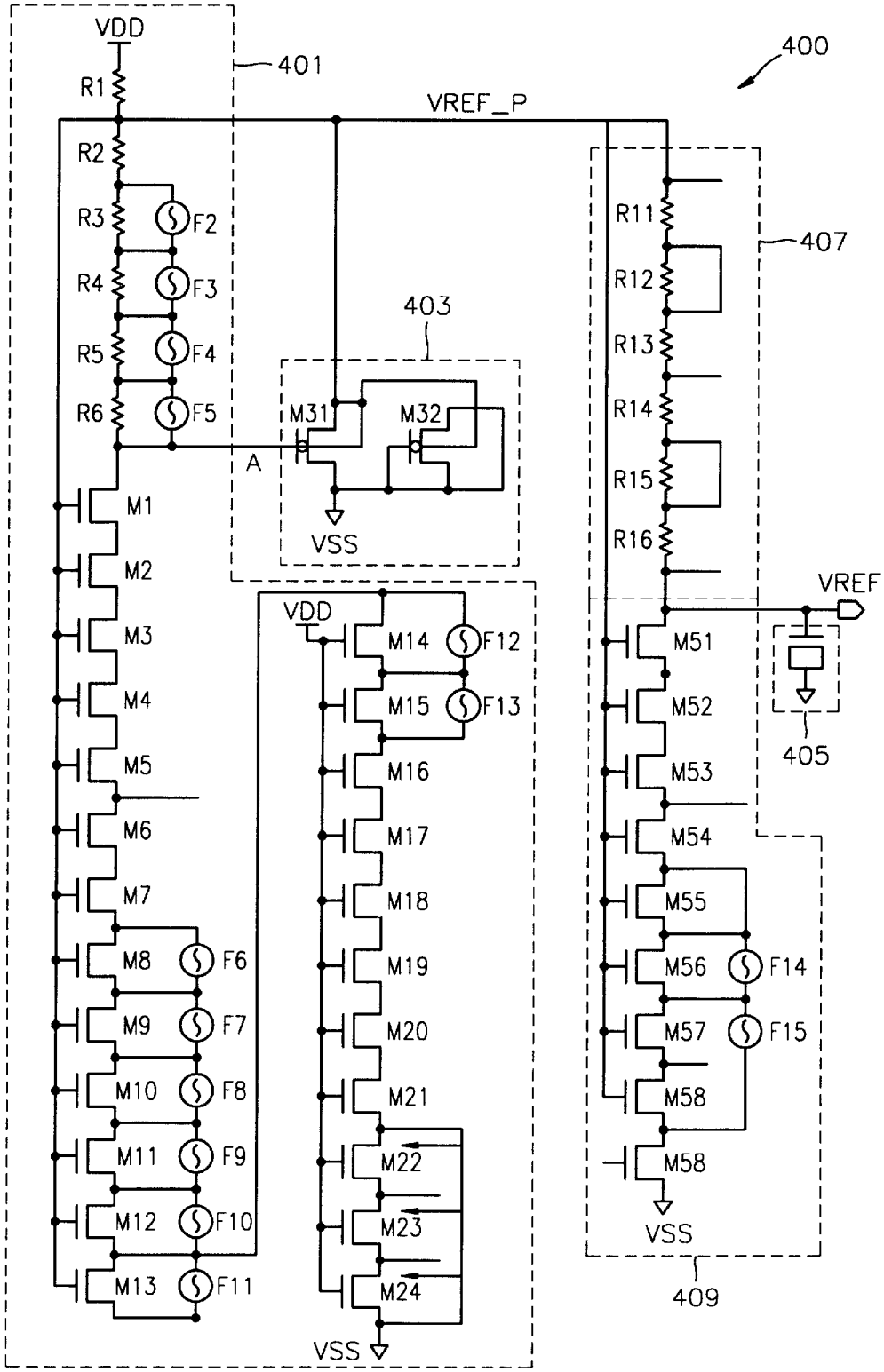
FIG. 4 is a circuit diagram of a reference voltage generator according to another preferred embodiment of the present invention.

FIG. 4 is a circuit diagram of a reference voltage generator 400 according to another preferred embodiment of the present invention. The reference voltage generator 400 is the same as the reference voltage generator 200 shown in FIG. 2 except a temperature compensator 407. The temperature compensator 407 comprises resistors R11~R16 instead of the PMOS transistors M41~M46 in the temperature compensator 207 shown in FIG. 2.

In the reference voltage generator 400 according to a preferred embodiment of the invention, the reference voltage VREF is controlled by the voltage compensator 409 responding to a preliminary reference voltage VREF_P set by a voltage bias unit 401 and a voltage controller 403. Since the resistors R12 and R15 of the temperature compensator 407 can be selectively short-circuited, the resistance of the temperature compensator 407 can be decreased. The temperature compensator 407 is less effective as compared to the temperature compensator 207 shown in FIG. 2. However, the reference voltage generator 400 can stably generate the reference voltage VREF using the voltage compensator 409 connected to the preliminary reference voltage VREF_P node. The operation of the reference voltage generator 400 is the same as the operation of the reference voltage generator 200 of FIG. 2 described above, and thus will not be described.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. A reference voltage generator comprising:

a voltage bias unit having a plurality of resistors and a first group of transistors serially connected between a power supply voltage node and a ground voltage node, and a preliminary reference voltage node connected to one of the plurality of resistors or transistors to produce a preliminary reference voltage;

a voltage controller connected between the preliminary reference voltage node and the ground voltage node to adjust the preliminary reference voltage;

a temperature compensator having a second group of transistors serially connected between the preliminary reference voltage node and a reference voltage node to compensate for temperature variation and produce a reference voltage; and a voltage compensator having a third group of transistors serially connected between the reference voltage node and the ground voltage node for controlling the reference voltage, and fuses for selectively short-circuiting at least two of the third group of transistors to vary the reference voltage.

2. The reference voltage of claim 1, wherein the voltage controller comprises a forth group of transistors for level adjusting the preliminary reference voltage.

3. The reference voltage generator of claim 1, wherein each of the gates of the second group of transistors is connected to the ground voltage node and a source or drain selectively short circuited.

4. The reference voltage generator of claim 3, wherein each of the second group of transistors is a PMOS transistor.

5. The reference voltage generator of claim 1, wherein each of the gates of the third group of transistors is connected to the preliminary reference voltage node and a source or drain selectively short circuited.

6. The reference voltage generator of claim 5, wherein each of the third group of transistors is an NMOS transistor.

7. A reference voltage generator comprising:

a voltage bias unit having a first group of resistors and a first group of transistors serially connected between a power supply voltage node and a ground voltage node, and a preliminary reference voltage node connected to one of the first group of resistors or the first group of transistors to produce a preliminary reference voltage;

a voltage controller connected between the preliminary reference voltage node and the ground voltage node to control the preliminary reference voltage;

a temperature compensator having a second group of resistors serially connected between the preliminary reference voltage node and a reference voltage; and a voltage compensator having a second group of transistors serially connected between the reference voltage node and the ground voltage node, and fuses for selectively short-circuiting at least two of the second group of transistors, wherein the voltage compensator and the temperature compensator are connected to compensate for temperature variation and produce a reference voltage.

8. The reference voltage generator of claim 7, wherein the resistor of the second group of resistors is selectively short-circuited to reduce resistance of the second group of resistors.

9. The reference voltage generator of claim 7, wherein each of the gates of the second group of transistors is connected to the preliminary reference voltage node and a source or drain selectively short circuited.

10. The reference voltage generator of claim 1, wherein the reference voltage is expressed by a following formula:

$$VREF = \text{VREF_P} * \frac{Rchn}{(Rchn + Rchp)}$$

wherein the VREF indicates the reference voltage, the VREP_P indicates the preliminary reference voltage, the Rchn indicates a channel resistance of the voltage compensator, and the Rchp indicates a channel resistance of the temperature compensator.

* * * * *